US007658173B2

(12) United States Patent
Carroll et al.

(10) Patent No.: US 7,658,173 B2
(45) Date of Patent: Feb. 9, 2010

(54) TAPPET FOR AN INTERNAL COMBUSTION ENGINE

(75) Inventors: Jason William Carroll, Williamsport, PA (US); Brock Spigelmyer, Willamsport, PA (US)

(73) Assignee: Lycoming Engines, a division of Avco Corporation, Williamsport, PA (US)

( * ) Notice: Subject to any disclaimer, the term of this patent is extended or adjusted under 35 U.S.C. 154(b) by 27 days.

(21) Appl. No.: 11/590,534

(22) Filed: Oct. 31, 2006

(65) Prior Publication Data

US 2008/0105229 A1 May 8, 2008

(51) Int. Cl.
*F01L 1/14* (2006.01)

(52) U.S. Cl. ..... 123/90.48; 123/90.51; 123/90.52

(58) Field of Classification Search ..... 123/90.48, 123/90.52, 90.6, 90.51, 90.55
See application file for complete search history.

(56) References Cited

U.S. PATENT DOCUMENTS

| | | | | |
|---|---|---|---|---|
| 4,023,988 | A * | 5/1977 | Stickels et al. | 148/622 |
| 4,270,496 | A * | 6/1981 | Narasimhan et al. | 123/90.51 |
| 4,430,970 | A | 2/1984 | Holtzberg et al. | 123/90.51 |
| RE32,167 | E | 6/1986 | Buente | 123/90.55 |
| 4,768,476 | A | 9/1988 | Behnke et al. | 123/90.51 |
| 5,289,804 | A | 3/1994 | Mori | 123/90.51 |
| 5,293,026 | A | 3/1994 | Dennis et al. | 219/121.59 |
| 6,619,251 | B2 | 9/2003 | Kobayashi et al. | 123/90.35 |
| 6,655,329 | B2 * | 12/2003 | Kammerdiener et al. | 123/90.16 |
| 2004/0074462 | A1 | 4/2004 | Mandal et al. | |
| 2004/0154570 | A1 * | 8/2004 | Mabuchi et al. | 123/90.52 |
| 2004/0165804 | A1 * | 8/2004 | Toda et al. | 384/544 |
| 2006/0005797 | A1 | 1/2006 | Schubeck | |
| 2006/0219200 | A1 | 10/2006 | Horimura et al. | |

FOREIGN PATENT DOCUMENTS

JP 62118014 A * 5/1987

OTHER PUBLICATIONS

A. Matthews, et al., "Engineering applications for diamond-like carbon", Diamond and Related Materials, 3 (1994), pp. 902-911.
Y.Liu, et al., "A study of the wear mechanism of diamond-like carbon films", Surface and Coatings Technology, 82 (1996), pp. 48-56.
Anonymous, "Manganese Phosphate for Iron and Steel," retrieved from Internet, URL: http://web.archive.org./web/20051126132237/http://www.epi.com/metal-finishes/manganese-phosphates.html, Nov. 26, 2005 (2 pages).
International Search Report for PCT Patent Application No. PCT/US2007/082658, issued Mar. 19, 2008, 4 pages.

* cited by examiner

*Primary Examiner*—Zelalem Eshete
(74) *Attorney, Agent, or Firm*—BainwoodHuang

(57) ABSTRACT

A tappet for an internal combustion engine is formed from a high-carbon, bearing grade steel. The high-carbon, bearing grade steel has a relatively high surface fatigue strength that provides the tappet with the ability to absorb a relatively large contact stresses during operation, thereby minimizing the formation of cracks within the tappet. Additionally, the high-carbon steel tappet can be heat treated to provide a substantially uniform hardness, between about 58 Rockwell Hardness C (HRC) and 62 HRC, and a substantially consistent microstructure throughout the tappet, thereby minimizing wear of the tappet during use.

20 Claims, 4 Drawing Sheets

TAPPET FOR AN INTERNAL COMBUSTION ENGINE

BACKGROUND

Conventional internal combustion engines utilize intake and exhaust valves to provide a flow of air into, and combusted gas from, the cylinders during operation. Internal combustion engines utilize a valve train that includes tappets, in conjunction with a rotating camshaft, to control the position of the intake and exhaust valves. Each tappet of the valve train is disposed within the engine between a cam on the camshaft and a pushrod linked to an intake or exhaust valve through the rocker arm. During operation, the camshaft rotates the cam relative to the tappet and causes the cam to slide across the tappet face. The sliding motion of the cam relative to the tappet causes the tappet to reciprocate within the engine, and by acting through the pushrod and rocker arm, actuate the intake or exhaust valve between an open and closed position.

SUMMARY

In use, as the cam slides across the tappet face, the valve train applies a relatively large, cyclically varying load to the tappet cam interface. To ensure the durability of the tappets under these operating conditions, the tappets are typically made from a cast iron material, such as chilled cast iron. The cyclically applied load, however, can fatigue the tappet and cause eventual failure of the tappet or the engine over time. For example, the interaction between the cam and the tappet can cause the tappet to become worn, crack, and/or spall (shed chips of material). Generally, such wearing of the tappets can alter the timing of the opening and closing of the valves and can reduce the overall engine efficiency (e.g., horsepower provided by the engine). Additionally, as the tappets shed chips of material, the chips can enter the oil system and potentially damage the engine.

Embodiments of the present invention relate to a tappet for an internal combustion engine where the tappet is formed from a high-carbon, bearing grade steel. The high-carbon, bearing grade steel has a relatively high surface fatigue strength that provides the tappet with the ability to absorb a relatively large contact stresses during operation, thereby minimizing abrasive wear and the formation of cracks within the tappet. Additionally, the high-carbon steel tappet can be heat treated to provide a substantially uniform hardness, between about 58 Rockwell Hardness C (HRC) and 62 HRC, and a substantially consistent microstructure throughout the tappet, thereby minimizing wear of the tappet during use.

In one embodiment, a tappet of an internal combustion engine includes a cam interface portion configured to contact a cam of the internal combustion engine and a pushrod interface portion extending from the cam interface portion, the pushrod interface portion being configured to interface with a valve operating mechanism of the internal combustion engine. In one embodiment, the tappet is formed of a high-carbon, bearing grade steel material. For example, the tappet is formed of a bearing grade steel material having a carbon content of about 1%, such as a Society of Automotive Engineers (SAE) 52100 bearing grade steel. The high-carbon, bearing grade steel minimizes wear, spalling, and crack formation and propagation in the tappet during use.

In one embodiment, an internal combustion engine includes a housing, a valve disposed within the housing, a valve operating mechanism coupled to the valve, and a camshaft having at least one cam disposed within the housing. The internal combustion engine includes a tappet disposed within a chamber of the housing between the cam of the camshaft and the valve operating mechanism. The tappet has a cam interface portion that contacts the cam and a pushrod interface portion configured to interface with the valve operating mechanism where the tappet is formed of a high-carbon, bearing grade steel material. The high-carbon, bearing grade steel minimizes wear, spalling, and crack propagation in the tappet during use. As a result, the high-carbon, bearing grade steel tappet allows the internal combustion engine to provide a substantially consistent horsepower output over time.

One embodiment of the invention relates to a method for producing a tappet for an internal combustion engine. The method includes forming a tappet from a high-carbon, bearing grade steel material, the tappet having a cam interface portion configured to contact a cam of the internal combustion engine and a pushrod interface portion configured to interface with a valve operating mechanism of the internal combustion engine. The method also includes heat treating the tappet to generate a substantially uniform hardness through the high-carbon, bearing grade steel material.

BRIEF DESCRIPTION OF THE DRAWINGS

The foregoing and other objects, features and advantages of embodiments of the invention will be apparent from the following description of particular embodiments of the invention, as illustrated in the accompanying drawings in which like reference characters refer to the same parts throughout the different views. The drawings are not necessarily to scale, emphasis instead being placed upon illustrating the principles of the embodiments.

DETAILED DESCRIPTION

Embodiments of the present invention relate to a tappet for an internal combustion engine where the tappet is formed from a high-carbon, bearing grade steel. The high-carbon, bearing grade steel has a relatively high surface fatigue strength that provides the tappet with the ability to absorb relatively large contact stresses during operation, thereby minimizing abrasive wear and the formation of cracks within the tappet. Additionally, the high-carbon steel tappet can be heat treated to provide a substantially uniform hardness, between about 58 Rockwell Hardness C (HRC) and 62 HRC, and a substantially consistent microstructure throughout the tappet, thereby minimizing wear of the tappet during use.

Figure 1:
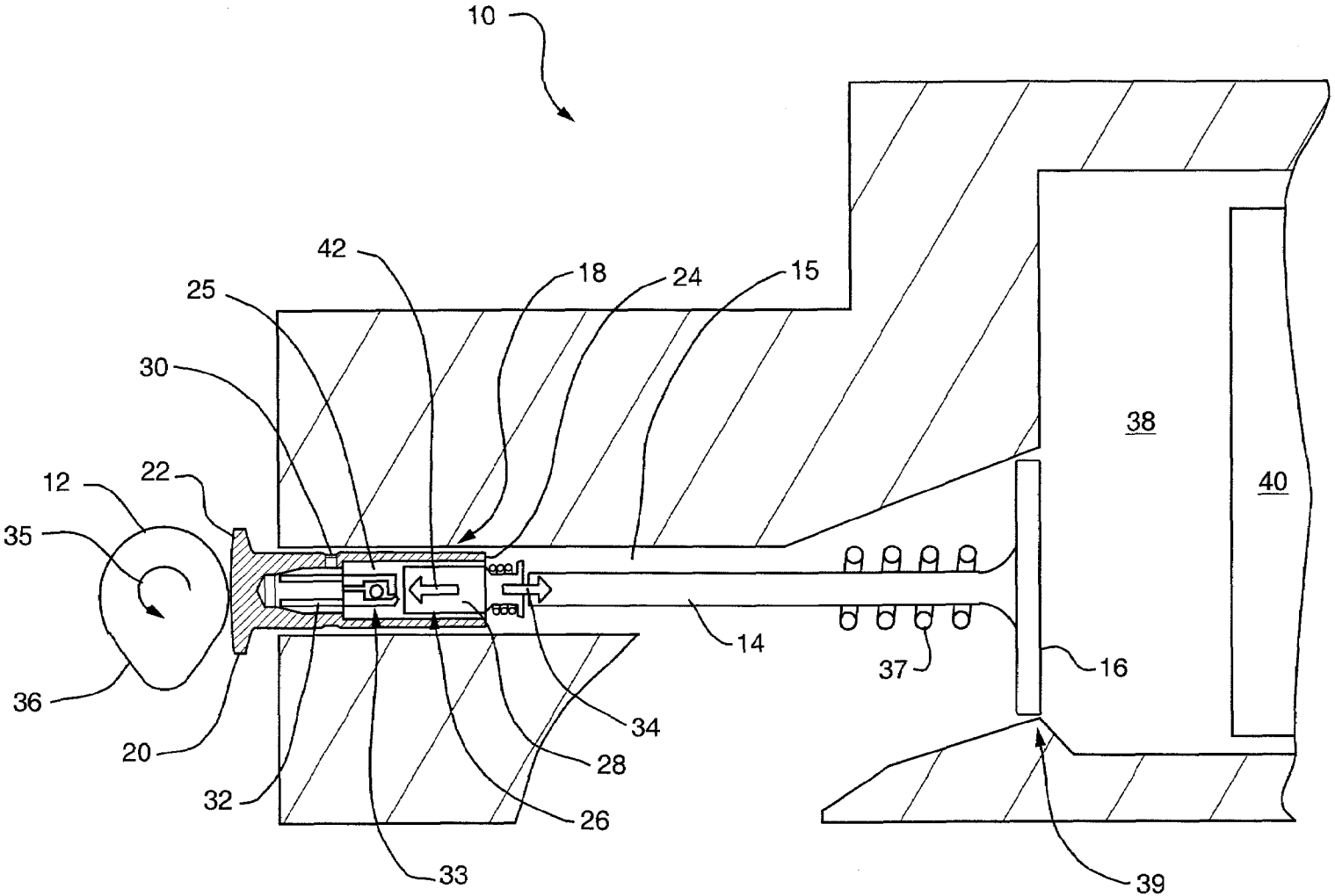
FIG. 1 illustrates an example of an internal combustion engine having a tappet formed from a high-carbon, bearing grade steel.

FIG. 1 illustrates a schematic, sectional view of an example internal combustion engine 10. The internal combustion engine 10 includes a cam 12, a valve operating mechanism 14 (e.g., a valve stem or pushrod), and a tappet assembly 18. The tappet assembly 18 is disposed between the cam 12 and the valve operating mechanism 14 within a guide bore 15 of the internal combustion engine 10.

The tappet assembly 18 includes a tappet 20 having a cam interface portion 22 that contacts the cam 12 and a pushrod interface portion 24 extending from the cam interface portion 22, the pushrod interface portion 24 being configured to interface with the valve operating mechanism 14. In the example shown, pushrod interface portion 24 defines a chamber 25 that contains a hydraulic assembly 26. In this example, the pushrod interface portion 24 of the tappet 20 interacts with the valve operating mechanism 14 though the hydraulic assembly 26. The hydraulic assembly 26 is operable to minimize clearances or tolerance errors between the tappet 20 and the valve operating mechanism 14. For example, oil from the internal combustion engine 10 enters the chamber 25 between the tappet 20 and a plunger 28 of the hydraulic assembly 26 through an opening 30 formed in the tappet 20 and though an inlet tube 32 of the hydraulic assembly 26. The oil, under pressure within the chamber 25 and maintained within the chamber 25 by a check valve 33, displaces the plunger 28 along a direction 34 until the plunger 28 contacts the valve operating mechanism 14.

In use, as the cam 12 rotates about a central axis along direction 35, a cam lobe 36 of the cam 12 slides across the cam interface portion 22 of the tappet 20. The interaction between the cam lobe 36 and the tappet 20 causes the tappet 20 to translate within the guide bore 15 along direction 34. Translation of the tappet 20 causes the valve operating mechanism 14 to translate along the direction 34, thereby compressing a spring 37 and moving a valve 16 away from a valve seat 39. With such translation of the tappet 20, the valve 16 is positioned in an open position to allow a flow of air into or a flow of combusted gas from a location 38 above a cylinder head 40 of the internal combustion engine 10. As the cam 12 further rotates along the direction 35, the cam lobe 36 of the cam 12 rotates away from the cam interface portion 22 of the tappet 20. This rotation reduces a force applied by the tappet 20 on the valve operating mechanism 14 and previously compressed spring 37. As a result, the compressed spring 37 expands and causes the valve operating mechanism 14 to translate the tappet 20 within the guide bore 15 along a direction 42 and to move the valve 16 toward the valve seat 39 to a closed position.

The cam 12 applies relatively large cyclic loads to the tappet 20. In order to minimize failure of the tappet 20 and maintain operation of the internal combustion engine 10, the tappet 20 is formed of a high-carbon, bearing grade steel material. High-carbon, bearing grade steel materials have a carbon content between about 0.45% and about 1%. In one arrangement, the tappet 20 is formed of a bearing grade steel material having a carbon content of about 1%, such as a Society of Automotive Engineers (SAE) 52100 bearing grade steel (ASTM A295-98 Standard Specification for High-Carbon Anti-Friction Bearing Steel).

Compared to conventional tappets formed from cast iron material, the tappet 20 formed from high-carbon, bearing grade steel has a relatively high yield strength. Yield strength is defined as the ability for a material to absorb stress prior to plastic deformation and is typically determined experimentally from a stress-strain curve resulting from tensile testing of the material. The relatively high yield strength of the high-carbon, bearing grade steel provides the tappet 20 with the ability to absorb a relatively large amount of stress during operation, such as caused by the cyclic loading of the tappet 20 by the cam 12. Because the high-carbon, bearing grade steel tappet 20 can absorb a relatively large amount of stress during operation, the tappet 20 exhibits a relatively high crack initiation threshold.

Additionally, tappets 20 manufactured from the high-carbon, bearing grade steel material have the ability to be through-hardened. In a through-hardening process, a material is heat treated to provide a substantially uniform hardness throughout the material where hardness is generally defined as the ability for a ferrous metal to resist plastic deformation. In one arrangement, the high-carbon, bearing grade steel tappet 20 undergoes a heat treating or through-hardening procedure that results in the tappet 20 having a substantially uniform hardness of between about 58 Rockwell Hardness C (HRC) and 62 HRC. The hardness range of this material is indicative of a material with a minimal abrasive wear rate. As such, as the cam 12 interacts with the cam contact surface 22, the tappet 20 experiences minimal abrasive wear. As a result, the high-carbon, bearing grade steel tappet 20 maintains the operation of the internal combustion engine 10 such that the engine 10 provides substantially consistent horsepower output over time.

Additionally, as a result of the through-hardening process, the tappet 20 has a substantially uniform micro-hardness throughout the entirety of the tappet 20 resulting from a tempered martensitic microstructure with uniformly distributed carbides (e.g., along the tappet's length and across the tappet's diameter). Conventional tappets formed of chilled cast iron have variable micro-hardness throughout the entirety of the tappet resulting from a microstructure consisting of a large carbide phase and pearlite. Also, the chill depth of the cam contact surface 22 of the tappet is finite, typically on the order of between about 0.05 and 0.08 inches in depth. Therefore, in the case where the cam contact surface 22 of the tappet 20 becomes worn or cracked, a manufacturer can machine (e.g., grind) the cam contact surface 22 of a through hardened SAE 52100 bearing grade steel tappet to remove the worn material. Because the hardness of the tappet 20 is substantially consistent along the length of the tappet 20, the resulting machined cam contact surface has substantially the same material properties as the previously worn face. As a result of using through-hardened high-carbon, bearing grade steel tappets 20, rather than replacing a worn tappet 20, a manufacturer has the ability to refurbish the tappet 20 to a like-new condition.

Also, the through-hardening process provides a substantially consistent microstructure of the high-carbon, bearing grade steel material forming the tappet 20. For example, after being exposed to the through-hardening process, the high-carbon, bearing grade steel tappet 20 has a microstructure of about 98% martensite and about 2% austenite. The substantially consistent microstructure provides the tappet 20 with dimensional stability over time. For example, with such dimensional stability the tappet 20 experiences minor or negligible changes to its geometric configuration over time.

During operation, as the cam 12 rotates about a central axis along direction 35, a cam lobe 36 of the cam 12 slides across the cam interface portion 22 of the tappet 20. As indicated above, while the material properties of the high-carbon, bearing grade steel forming the tappet 20 provide wear resistance to the tappet 20, additional coatings can be applied to the tappet 20 to provide additional wear resistance.

Figure 2:
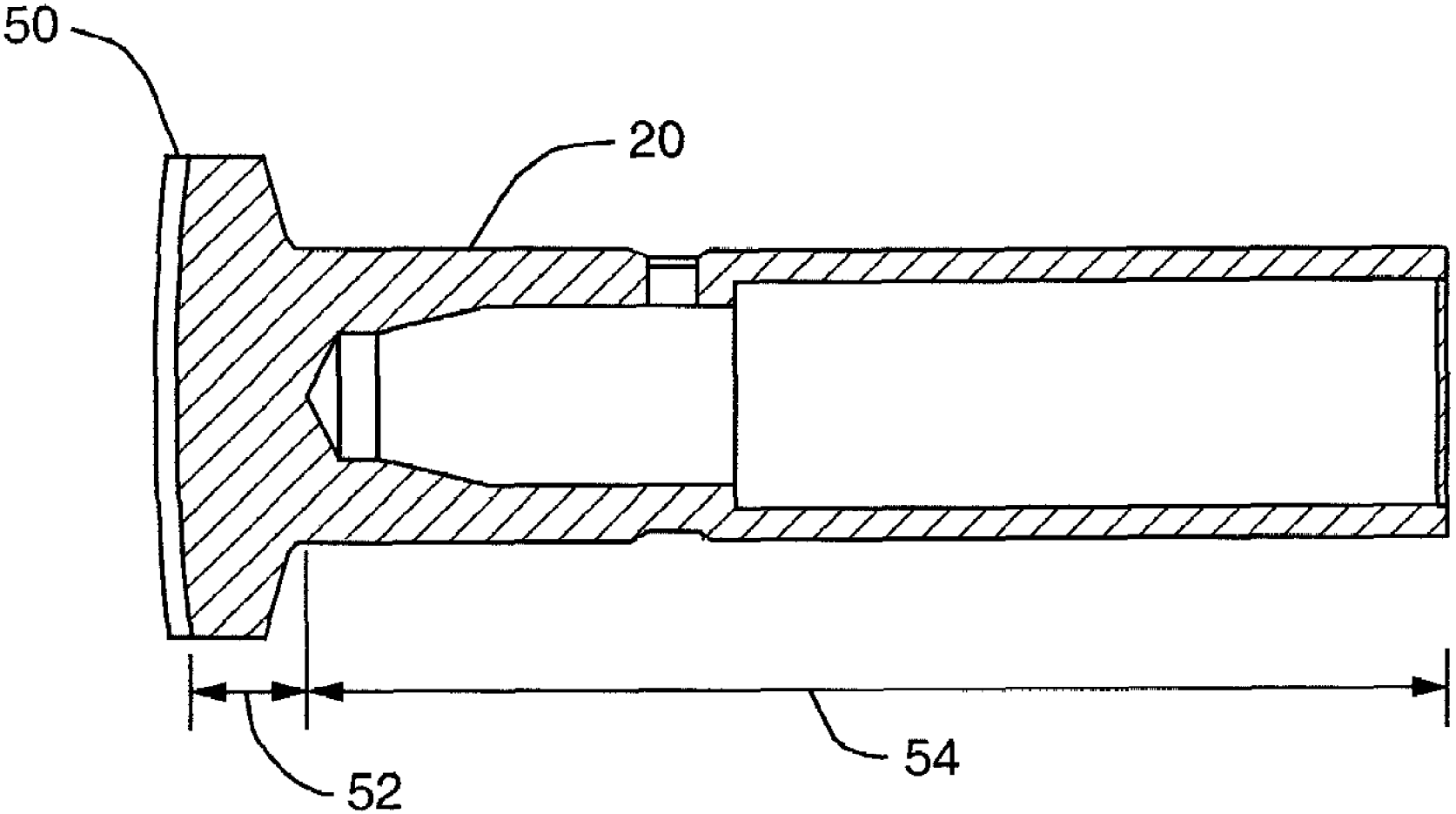
FIG. 2 illustrates an embodiment of the tappet of FIG. 1.

FIG. 2 illustrates an arrangement of the tappet 20 where the tappet 20 includes a coating 50, such as disposed on the cam interface portion 22 of the tappet 20. As indicated in FIG. 2, the coating 50 is disposed on the cam interface portion 22 of the tappet 20. The coating 50, however, can extend to an interface edge portion 52 about a diameter of the tappet 20. In one arrangement, a manufacturer applies minimal, if any, amounts of the coating to a body portion 54 of the tappet 50 in order to maintain the geometric size and tolerances of the tappet 20. During the manufacturing process, manufacturers use masking to limit the application of the coating to the interface edge portion 52 and the body portion 54 of the tappet 50.

Figure 3:
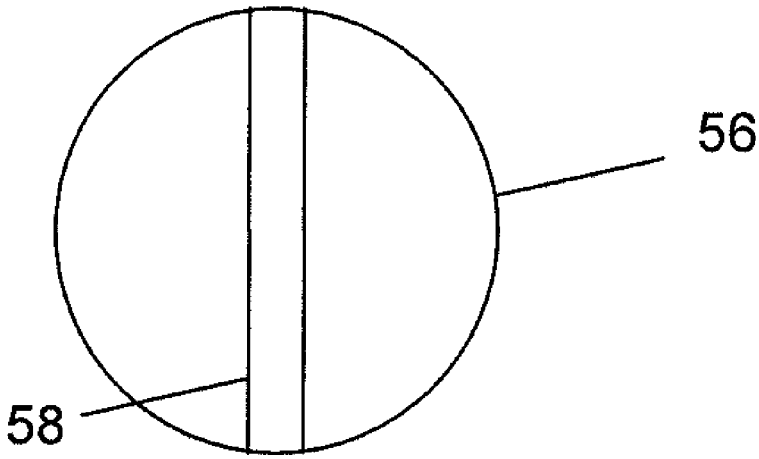
FIG. 3 illustrates a wear-in pattern formed in a cam contact portion of the tappet of FIG. 1.
Figure 4:
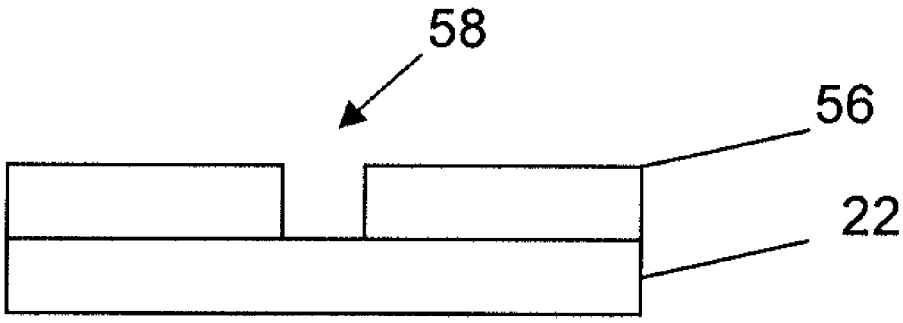
FIG. 4 is a side view of the wear-in pattern of the tappet of FIG. 3.

In one arrangement, the coating 50 is a break-in coating that allows marrying or wearing-in of the cam 12 and the tappet 20 during initial operation of the internal combustion engine 10. As indicated above, during operation, rotation of the cam 12 causes the cam 12 to slide across the cam contact surface 22 of the tappet 20. During the marrying process, as indicated in FIGS. 3 and 4, the break-in coating 56 is configured to allow formation of a wear-in pattern 58 on the cam interface portion 22 by the cam 12 as caused by the initial interaction between the cam 12 and the tappet 20. In one arrangement, the wear-in pattern 58 operates to minimize galling of the cam 12 and cam contact surface 22.

While a manufacturer can dispose various types of break-in coatings on the cam interface portion 22 of the tappet 20, in one arrangement, the manufacturer applies a break-in coating formed of a manganese phosphate material (e.g., as per the MIL-DTL-16232, Type M, Class 2 metal finishing specification) to the tappet 20. The manganese phosphate break-in coating provides a level of corrosion resistance by minimizing the ability for the cam contact surface 22 to oxidize.

In another example, the coating 50 is a wear coating configured as increase an overall operative lifetime of the tappet 20. For example, assume the tappet 20 illustrated in FIG. 1 has a lifetime of approximately 2000 hours at which time the tappet 20 requires replacement. The wear coating, as shown in FIG. 2, is configured to extend the lifetime of the tappet 20 beyond the 2000 hour limit. In one arrangement, the wear coating provides the extended lifetime to the tappet 20 because the hardness of the wear coating is greater than a hardness of the tappet 20. For example, the wear coating is a diamond-like carbon (DLC) film. Typically, DLC films are formed of a carbon material having an amorphous, non-crystalline carbon structure, such as produced through a chemical vapor deposition or sputter deposition process. DLC films have relatively high hardness values, in a range of about 3400 and about 4800 Knoop hardness (HK). Additionally, DLC films have relatively low coefficient of friction values, in a range of about 0.09 to about 0.15. Application of the DLC wear coating to the cam contact surface 22 of the tappet 20, therefore, provides the tappet 20 with additional resistance to wear as caused by the interaction between the cam 12 and the tappet 20 during operation.

Figure 5:
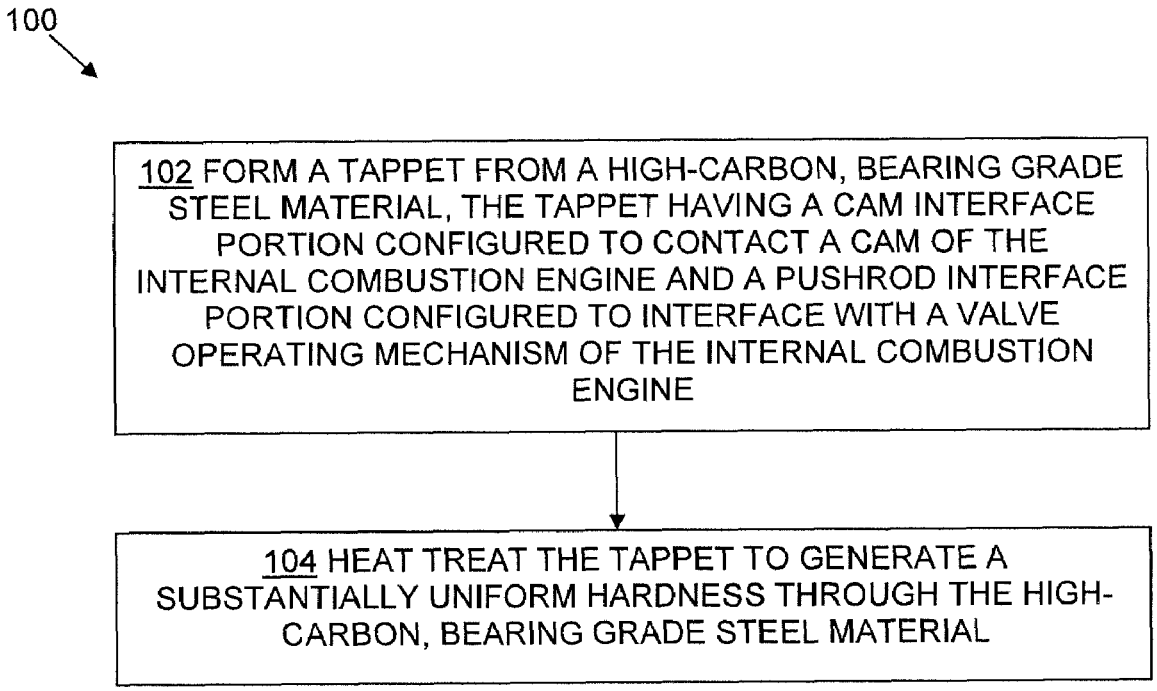
FIG. 5 is a flowchart illustrating an example method for producing a tappet for an internal combustion engine.

Generally, manufacturers produce tappets using a variety of manufacturing processes and techniques. FIG. 5 is a flowchart 100 that illustrates an example method for producing the tappet 20 for an internal combustion engine 10.

In step 102, a manufacturer forms a tappet from a high-carbon, bearing grade steel material, the tappet having a cam interface portion 22 configured to contact a cam 12 of the internal combustion engine 10 and a pushrod interface portion 24 configured to interface with a valve operating mechanism 14 of the internal combustion engine 10.

For example, a manufacturer initially receives a high-carbon, bearing grade steel material as bar stock from a supplier. In one arrangement, the manufacturer examines the quality of the high-carbon, bearing grade steel bar stock prior to forming the tappet 20. For example, in the case where the high-carbon, bearing grade steel material is SAE 52100 bearing grade steel, the manufacturer verifies that the material comports to the ASTM A295-98 Standard Specification for High-Carbon Anti-Friction Bearing Steel. Also, the manufacturer can evaluate a transverse microstructure associated with the SAE 52100 bearing grade steel, per ASTM A-892, with classifications for carbide size, carbide network, and lamella content of the SAE 52100 bearing grade steel. After the manufacturer confirms the quality of the high-carbon, bearing grade steel bar stock, the manufacturer performs a rough machining process on the material to form the geometry or shape of the tappet. In one arrangement, in the rough machining process, the manufacturer shapes the material to form the tappet, such as shown in FIG. 1.

Returning to FIG. 5, in step 104, the manufacturer heat treats (e.g., through hardens) the tappet 20 to generate a substantially uniform hardness through the high-carbon, bearing grade steel material. For example, the heat treating process produces a tappet 20 having a hardness between about 58 HRC and about 62 HRC. While the heat treatment process can include a variety of steps, the following provides an example heat treating process as applied to the tappet 20.

For example, at the start of the heat treating process, the manufacturer loads the tappet 20 into a furnace and hardens the tappet 20 by exposing the tappet 20 to a temperature of about 1525° F. for a period of about 1.25 and 2.5 hours. At the end of the hardening procedure, the manufacturer cools the tappet 20 by quenching the tappets in oil. In one arrangement, during the quenching operation, the oil is held at a temperature between about 150 and 200° F and the tappet 20 is immersed in the oil for a duration of between approximately 10 minutes and 30 minutes. Following the quenching the procedure, the manufacturer rinses the tappet 20 in hot water to remove excess oil from the tappet 20.

Within approximately one hour of the quenching procedure, the manufacturer then snap tempers the tappet 20 to stabilize the microstructure of the tappet 20. For example, during the snap tempering procedure, the manufacturer loads the tappet 20 into a furnace held at approximately 300° F for a time period between approximately 1 and 2 hours. Following this exposure, the manufacturer removes the tappet 20 from the furnace and allows the tappet 20 to air cool to ambient temperature. After the tappet 20 has cooled to ambient temperature, the manufacturer tempers the tappet 20 to achieve a tappet hardness between about 58 HRC and about 62 HRC. For example, the manufacturer places the tappet 20 into a furnace held at approximately 350° F for a time period of approximately 4 hours. Following this exposure, the manufacturer removes the tappet 20 from the furnace and allows the tappet 20 to air cool to ambient temperature.

Following the heat treating procedure, the manufacturer can perform additional processing steps on the tappet 20. For example, in one arrangement, following the snap tempering procedure, the manufacturer then machines the tappet 20 to its final dimensions, such as through a grinding procedure. In one arrangement, when the manufacturer is to apply a coating 50 to the cam contact surface 22 of the tappet 20, the manufacturer first physically prepares the cam contact surface 22 to accept the coating 50. The manufacturer then applies the coating 50 such as through a vapor deposition or sputtering process.

While embodiments of the invention has been particularly shown and described with references to preferred embodiments thereof, it will be understood by those skilled in the art that various changes in form and details may be made therein without departing from the spirit and scope of the invention as defined by the appended claims.

For example, FIGS. 1 and 2 illustrate the cam interface portion 22 of the tappet 20 as being mushroom-shaped or crowned. Such illustration is by way of example only. In one arrangement, the cam interface portion of the tappet 20 is substantially flat or non-curved.

FIG. 2 illustrates the tappet 20 as having a single coating 50. The coating 50 is described as being either a break-in coating or a wear coating. Such illustration and description is by way of example only. In one arrangement, the tappet 20 includes both a break-in coating and a wear coating, such as disposed on the cam contact surface 22.

In the embodiment of the tappet 20 described above, the pushrod interface portion 24 defines a chamber 25 that contains a hydraulic assembly 26 which interacts with the valve operating mechanism 14 and is operable to minimize clearances or tolerance errors between the tappet 20 and the valve operating mechanism 14. Such description is by way of example only.

The push rod interface portion 24 of the high-carbon, bearing grade steel tappet 20 can be configured in a variety of ways. For example, the pushrod interface portion 24 can be configured as a pushrod socket that is integrally formed with the tappet 20. In such a configuration, the pushrod socket interfaces with a pushrod (e.g., when the valve operating mechanism 14 is configured as a pushrod), such as incorporated as part of a general aviation piston engine.

As described above, the tappet 20 is formed of a high-carbon, bearing grade steel material, such as SAE 52100 bearing grade steel. One of ordinary skill in the art will understand that the tappet 20 can also be formed of a high-carbon, aircraft quality steel such as SAE 52100 aircraft quality steel.

What is claimed is:

1. A tappet of an internal combustion engine, the tappet comprising:

a cam interface portion configured to contact a cam of the internal combustion engine;

a pushrod interface portion extending from the cam interface portion, the push rod interface portion being configured to interface with a valve operating mechanism of the internal combustion engine, wherein the pushrod interface portion defines a chamber configured to contain a hydraulic assembly, the hydraulic assembly configured to contact the valve operating mechanism;

wherein the cam interface portion of the tappet is formed of a high-carbon, bearing grade steel material; and wherein the pushrod interface portion extending from the cam interface portion is formed of the high-carbon, bearing grade steel material.

2. The tappet of claim 1, wherein the high-carbon, bearing grade steel material has a carbon content between about 0.45% and about 1%.

3. The tappet of claim 1 further comprising a break-in coating disposed on the cam interface portion of the tappet, the break-in coating configured to allow formation of a wear-in pattern on the cam interface portion by the cam.

4. The tappet of claim 3, wherein the break-in coating comprises a manganese phosphate material.

5. The tappet of claim 3, wherein the wear-in pattern formed by the break-in coating is configured to limit galling of the cam interface portion and the cam of the internal combustion engine.

6. The tappet of claim 1, further comprising a wear coating disposed on the cam interface portion of the tappet, a hardness of the wear coating being greater than a hardness of the tappet.

7. The tappet of claim 6, wherein the wear coating comprises a diamond-like carbon (DLC) film formed of a carbon material having a substantially amorphous, non-crystalline carbon structure.

8. The tappet of claim 1, wherein the high-carbon, bearing grade steel material having a hardness that is substantially uniform along a length of the tappet, the substantially uniform hardness being between about 58 Rockwell Hardness C (HRC) and 62 HRC.

9. The tappet of claim 8, wherein the high-carbon, bearing grade steel material having a microstructure of about 98% martensite and about 2% austenite.

10. The tappet of claim 1, wherein:

the pushrod interface portion is integrally formed with the cam interface portion;

the high-carbon, bearing grade steel material of the cam interface portion is configured as a bearing element to receive a rolling contact load from the cam; and the high-carbon, bearing grade steel material of the pushrod interface portion is configured as a non-bearing element to house the hydraulic assembly.

11. The tappet of claim 1, wherein the high-carbon, bearing grade steel material comprises SAE 52100 bearing grade steel.

12. An internal combustion engine, comprising:

a housing;

a valve disposed within the housing;

a valve operating mechanism coupled to the valve;

a camshaft having at least one cam disposed within the housing; and a tappet disposed within a chamber of the housing between the cam of the camshaft and the valve operating mechanism, the tappet having a cam interface portion contacting the cam and a pushrod interface portion extending from the cam interface portion, the pushrod interface portion being configured to interface with the valve operating mechanism, wherein the pushrod interface portion defines a chamber configured to contain a hydraulic assembly, the hydraulic assembly configured to contact the valve operating mechanism, wherein the cam interface portion of the tappet is formed of a high-carbon, bearing grade steel material; and wherein the pushrod interface portion of the tappet is formed of the high-carbon, bearing grade steel material.

13. The internal combustion engine of claim 12, wherein the high-carbon, bearing grade steel material comprises a carbon content between about 0.45% and about 1%.

14. The internal combustion engine of claim 12, further comprising a break-in coating disposed on the cam interface portion, the break-in coating configured to allow formation of a wear-in pattern on the cam interface portion by the cam.

15. The internal combustion engine of claim 14, wherein the wear-in pattern formed by the break-in coating is configured to limit galling of the cam interface portion and the cam of the internal combustion engine.

16. The internal combustion engine of claim 12, further comprising a wear coating disposed on the cam interface portion, a hardness of the wear coating being greater than a hardness of the tappet.

17. The internal combustion engine of claim 16, wherein the wear coating comprises a diamond-like carbon (DLC) film formed of a carbon material having a substantially amorphous, non-crystalline carbon structure.

18. The internal combustion engine of claim 12, wherein the high-carbon, bearing grade steel material having a hardness that is substantially uniform along a length of the tappet, the substantially uniform hardness being between about 58 Rockwell Hardness C (HRC) and 62 HRC.

19. The tappet of claim 18, wherein the high-carbon, bearing grade steel material having a microstructure of about 98% martensite and about 2% austenite.

20. A tappet of an internal combustion engine, the tappet comprising:

a cam interface portion configured to contact a cam of the internal combustion engine;

a pushrod interface portion extending from the cam interface portion, the push rod interface portion being configured to interface with a valve operating mechanism of the internal combustion engine, wherein the pushrod interface portion defines a chamber configured to contain a hydraulic assembly, the hydraulic assembly configured to contact the valve operating mechanism; and the cam interface portion of the tappet and the pushrod interface portion of the tappet being formed of a high-carbon, bearing grade steel material, the high-carbon, bearing grade steel material having:

a hardness that is substantially uniform along a length of the tappet, the substantially uniform hardness being between about 58 Rockwell Hardness C (HRC) and 62 HRC; and a microstructure of about 98% martensite and about 2% austenite.

* * * * *